US012546182B2

(12) United States Patent
Gupta et al.

(10) Patent No.: US 12,546,182 B2
(45) Date of Patent: Feb. 10, 2026

(54) HIGH EXPANSION PACKER ASSEMBLY

(71) Applicant: Schlumberger Technology Corporation, Sugar Land, TX (US)

(72) Inventors: Susheel Kumar Gupta, Rosharon, TX (US); Farshad Odakkal, Rosharon, TX (US); Oscar V. Rodriguez, Rosharon, TX (US); Richard James Windslow, Rosharon, TX (US); Henghua Jin, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/715,536

(22) PCT Filed: Dec. 5, 2022

(86) PCT No.: PCT/US2022/051834
§ 371 (c)(1),
(2) Date: May 31, 2024

(87) PCT Pub. No.: WO2023/107382
PCT Pub. Date: Jun. 15, 2023

(65) Prior Publication Data

US 2025/0034965 A1 Jan. 30, 2025

(30) Foreign Application Priority Data

Dec. 8, 2021 (IN) ..... 202121057065

(51) Int. Cl.
*E21B 33/12* (2006.01)
*E21B 23/06* (2006.01)

(52) U.S. Cl.
CPC ..... *E21B 33/1216* (2013.01); *E21B 23/06* (2013.01)

(58) Field of Classification Search
CPC ..... E21B 33/1216; E21B 23/06
See application file for complete search history.

(56) References Cited

U.S. PATENT DOCUMENTS 3,587,736 A * 6/1971 Brown ..... E21B 33/1285 166/187
7,455,118 B2 11/2008 Roberts et al.
(Continued)

FOREIGN PATENT DOCUMENTS

WO 2013025709 2/2013
WO 2014089150 6/2014

OTHER PUBLICATIONS

International Search Report and Written Opinion issued on Apr. 20, 2023 in PCT Application No. PCT/US22/51834.

*Primary Examiner* — D. Andrews
(74) *Attorney, Agent, or Firm* — Jeffrey D. Frantz

(57) ABSTRACT

A packer assembly for use within a wellbore. The packer assembly may include a mandrel, a seal assembly disposed about the mandrel, and a deployment system disposed about the mandrel. The seal assembly may include a cup holder and a cup shaped sealing element coupled to the cup holder at a first end and deployable to create a seal between the mandrel and a wellbore wall. The deployment system may include a plurality of arc arms rotatingly coupled to the cup holder and a stack assembly that includes a plurality of packer elements that, when compressed, rotate the plurality of arc arms to deploy the cup shaped sealing element.

10 Claims, 11 Drawing Sheets

(56) References Cited

U.S. PATENT DOCUMENTS

| | | | |
|---|---|---|---|
| 8,651,178 | B2 | 2/2014 | Mercer et al. |
| 2004/0069502 | A1 | 4/2004 | Luke |
| 2014/0116680 | A1 | 5/2014 | Mercer et al. |
| 2015/0191991 | A1 | 7/2015 | Ezell |
| 2017/0145780 | A1 | 5/2017 | Castro et al. |
| 2018/0087346 | A1 | 3/2018 | Rochen |

* cited by examiner

HIGH EXPANSION PACKER ASSEMBLY

CROSS-REFERENCE TO RELATED APPLICATIONS

This application is a National Stage Entry of International Patent Application No. PCT/US2022/051834, filed Dec. 5, 2022, which claims the benefit of Indian Patent Application number 202121057065 entitled "High Expansion Cup Seal Element and Deployment System For Circular or Irregular/Non-Circular Holes," filed Dec. 8, 2021, the disclosure of which is incorporated herein by reference in its entirety.

BACKGROUND

Hydrocarbons produced from a subterranean formation oftentimes have sand or other particulates disposed therein. As the sand is undesirable to produce, many techniques exist for reducing the sand content in the hydrocarbons. Gravel packing is one technique used to filter and separate the sand from the hydrocarbons in a wellbore. Gravel packing generally involves pumping a gravel slurry, including gravel dispersed within a carrier fluid, down a work string and into the annulus formed between a completion assembly and the wall of the wellbore. The gravel is used to filter and separate the sand from the hydrocarbons as the hydrocarbons flow from the formation, into a completion assembly, and up to the surface.

One or more packers are oftentimes set or actuated prior to gravel packing. Upon actuation, the packers expand radially outward into contact with the wall of the wellbore to isolate different layers or zones of the formation. Isolating the different zones prevents the cross-flow of fluids (e.g., hydrocarbon fluids such as oil or gas) between the different zones and reduces the amount of water produced from the formation.

SUMMARY

A packer assembly for use within a wellbore according to one or more embodiments of the present disclosure includes a mandrel, a seal assembly disposed about the mandrel, and a deployment system disposed about the mandrel. The seal assembly includes a cup holder and a cup shaped sealing element coupled to the cup holder at a first end and deployable to create a seal between the mandrel and a wellbore wall. The deployment system includes a plurality of arc arms rotatingly coupled to the cup holder and a stack assembly that includes a plurality of packer elements that, when compressed, rotate the plurality of arc arms to deploy the cup shaped sealing element.

A completion system according to one or more embodiments of the present disclosure includes a tubing string positionable within the wellbore and a packer assembly coupled to the tubing string. The packer assembly includes a mandrel, a seal assembly disposed about the mandrel, and a deployment system disposed about the mandrel. The seal assembly includes a cup holder and a cup shaped sealing element coupled to the cup holder at a first end and deployable to create a seal between the mandrel and a wellbore wall. The deployment system includes a plurality of arc arms rotatingly coupled to the cup holder and a stack assembly that includes a plurality of packer elements that, when compressed, rotate the plurality of arc arms to deploy the cup shaped sealing element.

A method of completing a wellbore according to one or more embodiments of the present disclosure includes positioning a packer assembly within a wellbore. The method also includes rotating a plurality of arc arms of a deployment system via a stack assembly of a deployment system to deploy a cup shaped sealing element of a seal assembly to create a seal between a mandrel of the packer assembly and a wellbore wall. The method further includes compressing the stack assembly such that the stack assembly contacts the cup shaped sealing element to increase contact stress between the cup shaped sealing element and the wellbore wall.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

Figure 1:
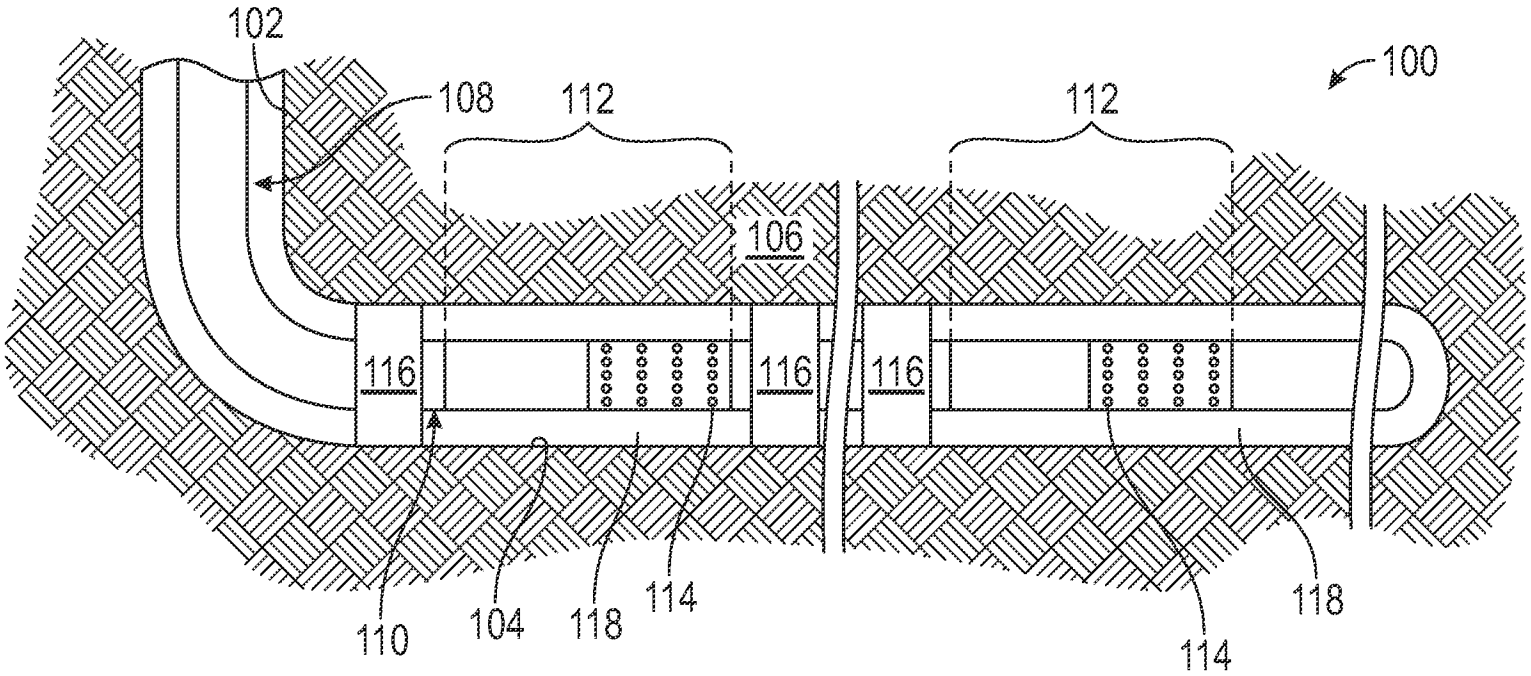
FIG. 1 is a schematic view of a well system according to one or more embodiments of the present disclosure.

Referring now to FIG. 1, FIG. 1 is a well system 100 that includes a wellbore 102 having a deviated wellbore section 104 extending into a formation 106 containing hydrocarbon fluids. Depending on the application, the wellbore 102 may comprise one or more deviated wellbore sections 104, e.g. horizontal wellbore sections, which may be cased or uncased. In the example illustrated, a tubing string 108 is deployed downhole into wellbore 102 and comprises a downhole well completion system 110 deployed in the deviated, e.g. horizontal, wellbore section 104.

The downhole well completion 110 system may be constructed to facilitate production of well fluids and/or injection of fluids. By way of example, the downhole well completion 110 system may comprise at least one sand screen joint 112, e.g. a plurality of screen assemblies 112. Each sand screen joint 112 may include a shroud, e.g. a sand screen, 114 that cover a screen filter through which fluid may enter the corresponding sand screen joint 112 for production to a suitable location, e.g. a surface location. For example, hydrocarbon well fluids may flow from formation 106, into wellbore 102, and into the screen assemblies 112 via the shrouds 114. In some embodiments, the downhole well completion system 110 also may comprise a plurality of packers 116 which may be used to isolate sections or zones 118 along the wellbore 102.

Figure 2:
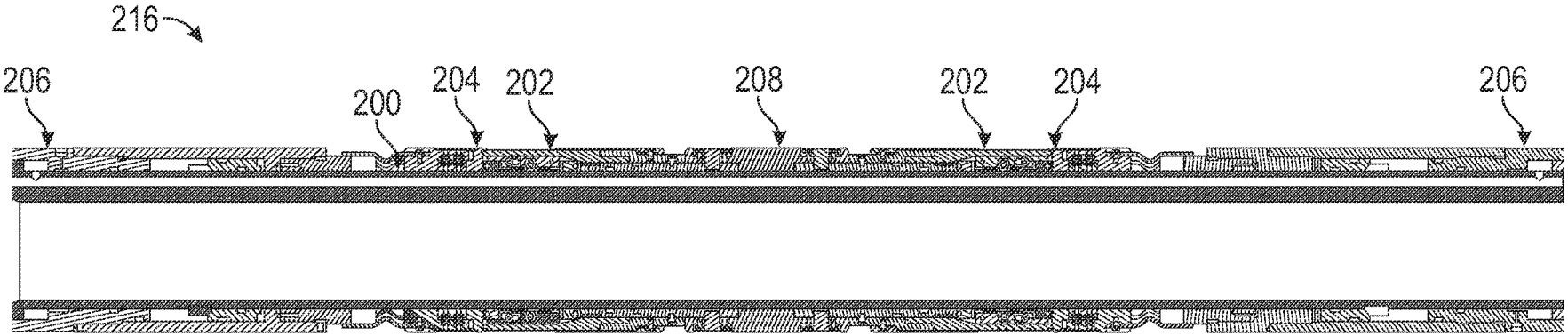
FIG. 2 is a packer assembly according to one or more embodiments of the present disclosure.

Turning now to FIG. 2, FIG. 2 is a packer assembly 216 that includes a tubular mandrel 200, two seal assemblies 202 positioned around the mandrel 200, and two deployment systems 204 that each include a piston 206 to activate the respective seal assemblies 202. In one or more embodiments, the deployment system 204 may utilize wellbore pressure to activate the seal assemblies 202. In other embodiments, the deployment system 204 may utilize hydraulic pressure from the surface or a downhole tool to activate the seal assemblies 202.

As shown in FIG. 2, the seal assemblies 202 are mirrored about a center gauge ring 208 coupled to the mandrel 200. When the seal assemblies 202 are activated via the deployment systems 204, the seal assemblies 202 expand radially, as described in more detail below, to seal the annulus between the mandrel 200 and a tubular or wellbore wall. Once deployed, the seal assemblies 202 will be further energized via pressure within the annulus.

Figure 3:
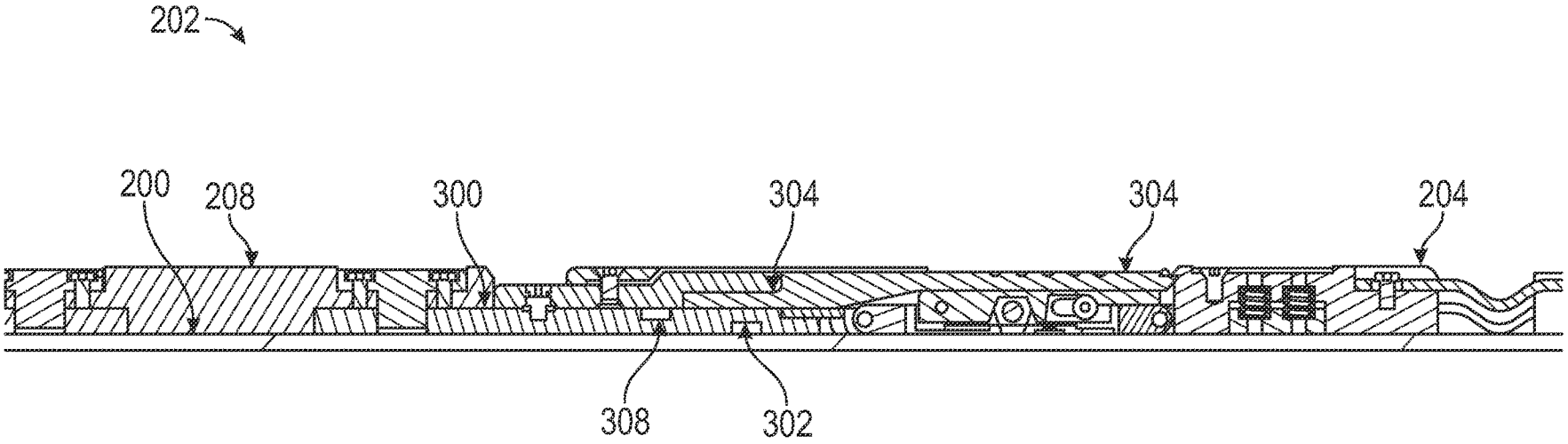
FIG. 3 is an enlarged view of the sealing assembly of the packer assembly of FIG. 2.

Turning now to FIG. 3, FIG. 3 is an enlarged view of the seal assembly 202 of FIG. 2. The seal assembly 202 includes cup holder 300 that may be coupled to the center gauge ring 208. In one or more embodiments, the cup holder 300 includes a seal 302 that seals against the mandrel 200 and a cup bonded element 304, which includes a cup shaped sealing element 306, is coupled to the cup holder 300. An additional seal 308 seals between cup holder 300 and cup bonded element 304. When the packer assembly 216 is deployed via the deployment system 204, the seals 302, 308 restrict fluid flow through the bore of the cup bonded element 304 to further seal the annulus between the mandrel 200 and a tubular or wellbore wall.

Figure 4:
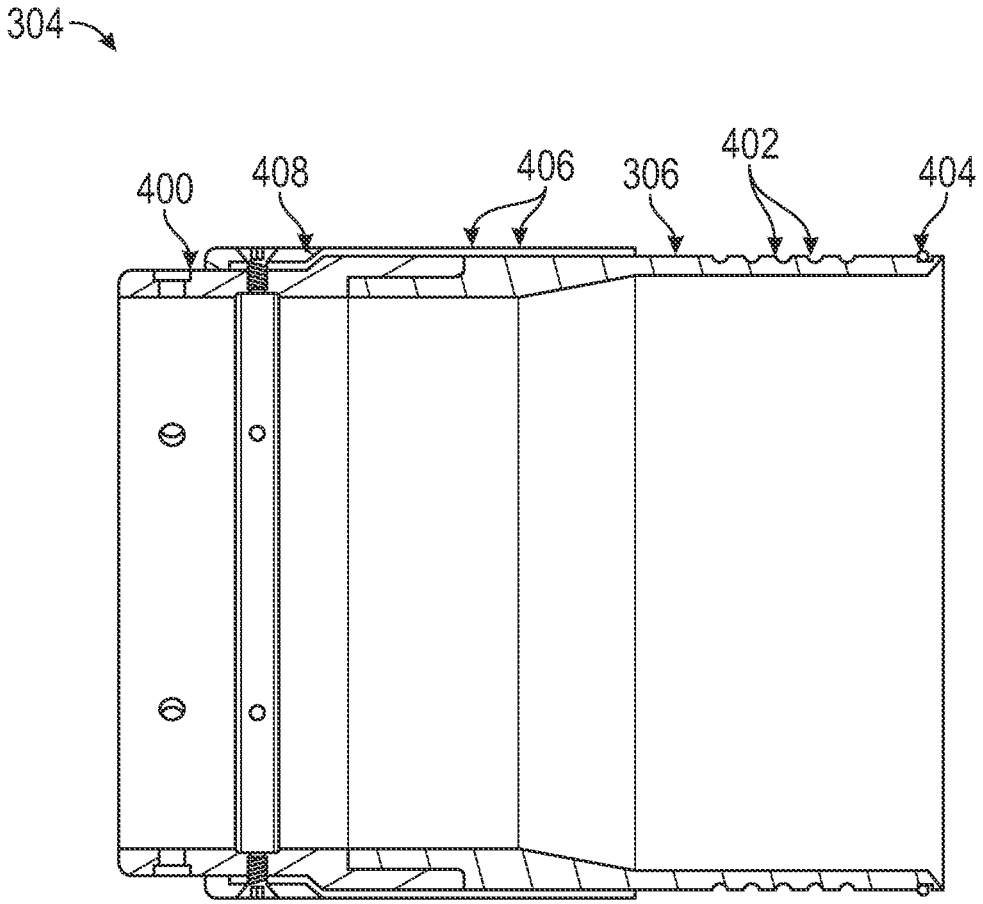
FIG. 4 is a cross-sectional view of the cup bonded system of the seal assembly of FIG. 3.

Turning now to FIG. 4, FIG. 4 shows an enlarged view of the cup bonded element 304 of the seal assembly 202. As discussed above, the cup bonded element 304 includes a sealing element 306 bonded to a cup holder 400. In one or more embodiments, the sealing element 306 is an elastomer and the cup holder is made from a metallic material. The sealing element 306 may have one or more grooves 402 formed on the outer surface of the sealing element 306 to aid in sealing against a tubular or wellbore wall. In one or more embodiments, the sealing element 306 also includes one or more elastomeric rings 404 that provide resistance against premature expansion of the sealing element 306 while the sealing element 306 is being run downhole.

Figure 5:
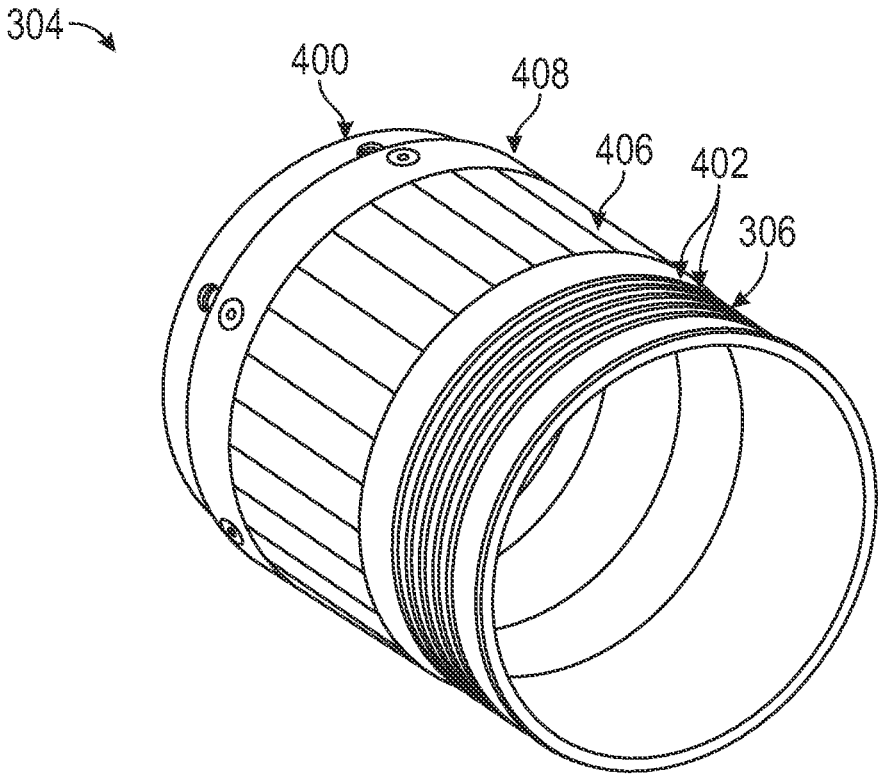
FIG. 5 is an isometric view of the cup bonded system of the seal assembly of FIG. 3.

The cup bonded element 304 may also include one or more foldback rings 406 coupled to the cup holder 400 via a ring holder 408, as shown in FIG. 5. In one or more embodiments, the foldback rings 406 are slotted and made of a material having sufficient plasticity to contain the sealing element 306 as the packer assembly 216 deployed. Once the packer assembly 216 is deployed, the foldback rings 406 reduce or prevent extrusion of the sealing element.

Figure 6:
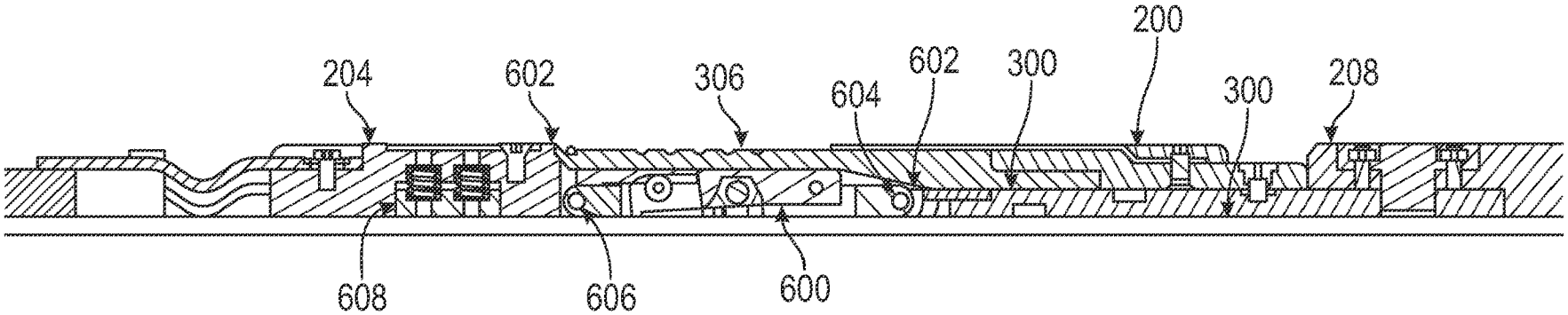
FIG. 6 is an enlarged view of the deployment system of FIG. 2.
Figure 7B:
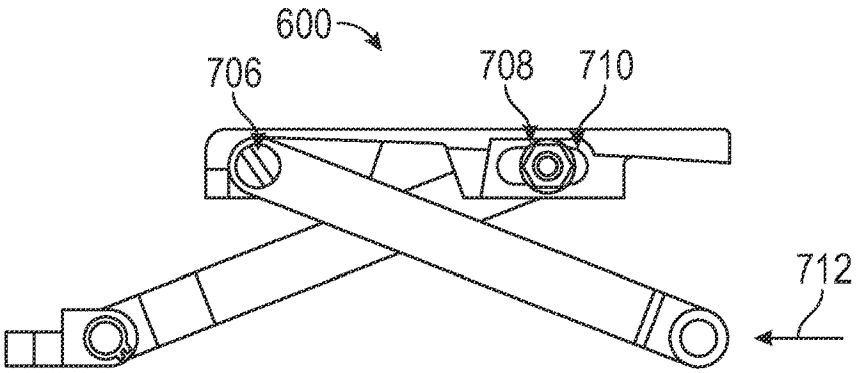
FIG. 7B is a side view of the lever assembly of the deployment system of FIG. 6 in a second position.
Figure 7A:
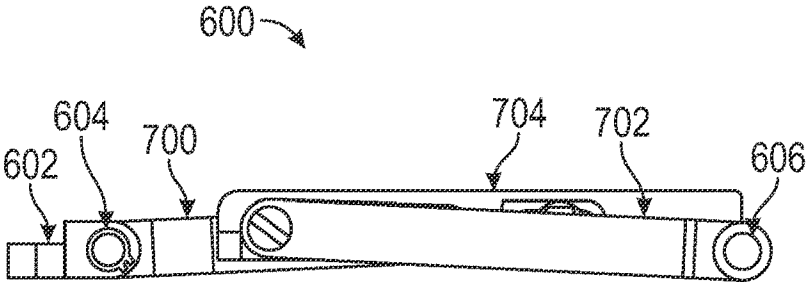
FIG. 7A is a side view of the lever assembly of the deployment system of FIG. 6 in a first position.

Turning now to FIG. 6, FIG. 6 is an enlarged view of the deployment system 204 of the packer assembly 216. The deployment system 204 is coupled to the cup holder 300 and rotates a plurality of lever assemblies 600 that each include hinge mechanisms, e.g., a pin 602 and clevis 604 or a pin joint 606, coupled to respective ratchet segments 608 to deploy the seal assembly 202. Additionally, an end 610 of the sealing element 306 is retained by the deployment system 204 to prevent premature expansion of the seal assembly As shown in FIGS. 7A-7B, the lever assemblies 600 each include a static lever 700, a dynamic lever 702, and an expanding pad 704. The expanding pad 704 is coupled to the dynamic lever 702 via a pin joint 706 and coupled to the static lever 700 via a cam 708 inside a slot 710. The static lever 700 is coupled to the clevis 604 via a pin 602. The dynamic lever 702 is coupled to the ratchet segment 608 via a pin joint 606. When a load is applied in the direction of arrow 712, the rotation at the pin 602 and the pin joints 606, 706 and the sliding of the cam 708 inside the slot 710 results in the radial expansion of the expanding pad 704.

Figure 8:
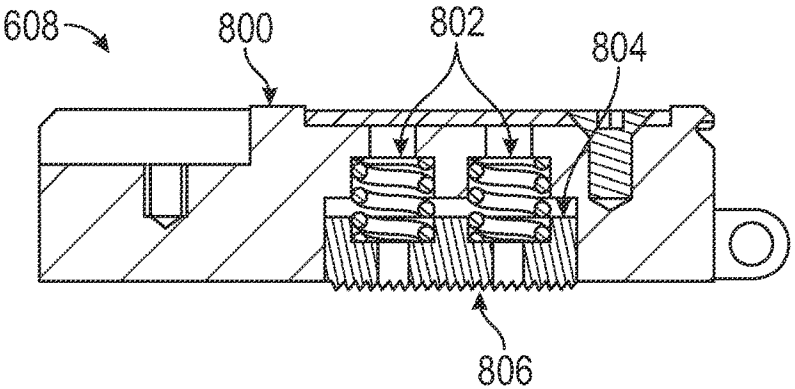
FIG. 8 is a ratchet segment of the deployment system of FIG. 6.

Turning now to FIG. 8, FIG. 8 shows a ratchet segment 608 of the deployment system 204. The ratchet segment 608 includes a segmented housing 800, one or more biasing mechanism (e.g., springs) 802, and a ratchet body 804. The ratchet body 804 includes a ratchet profile 806 that engages with mating ratchet profile formed by or coupled to the mandrel 200. The ratchet segment 608 placed inside segmented housing with a spring (53). When a load is applied to the ratchet segment 608 to expand the lever assembly 600, the biasing mechanism compresses to allow motion in a direction to deploy the packer 216. When the load is removed, the ratchet profile 806 prevents backward motion of ratchet segment 800 over tubular mandrel 200, thus retaining the lever assembly 600 in its expanded position. In one or more embodiments, each side of the segment housing 800 includes an interlocking profile that interlocks with an adjacent segment housing 800. The interlocking profile can also allow a relative axial motion between housing segments 800 to enable the independent radial expansion of the lever assemblies 600. The relative axial motion of the housing segments 800 allows the packer to be deployed in both round and irregular (i.e., not round) wellbores.

Figure 9:
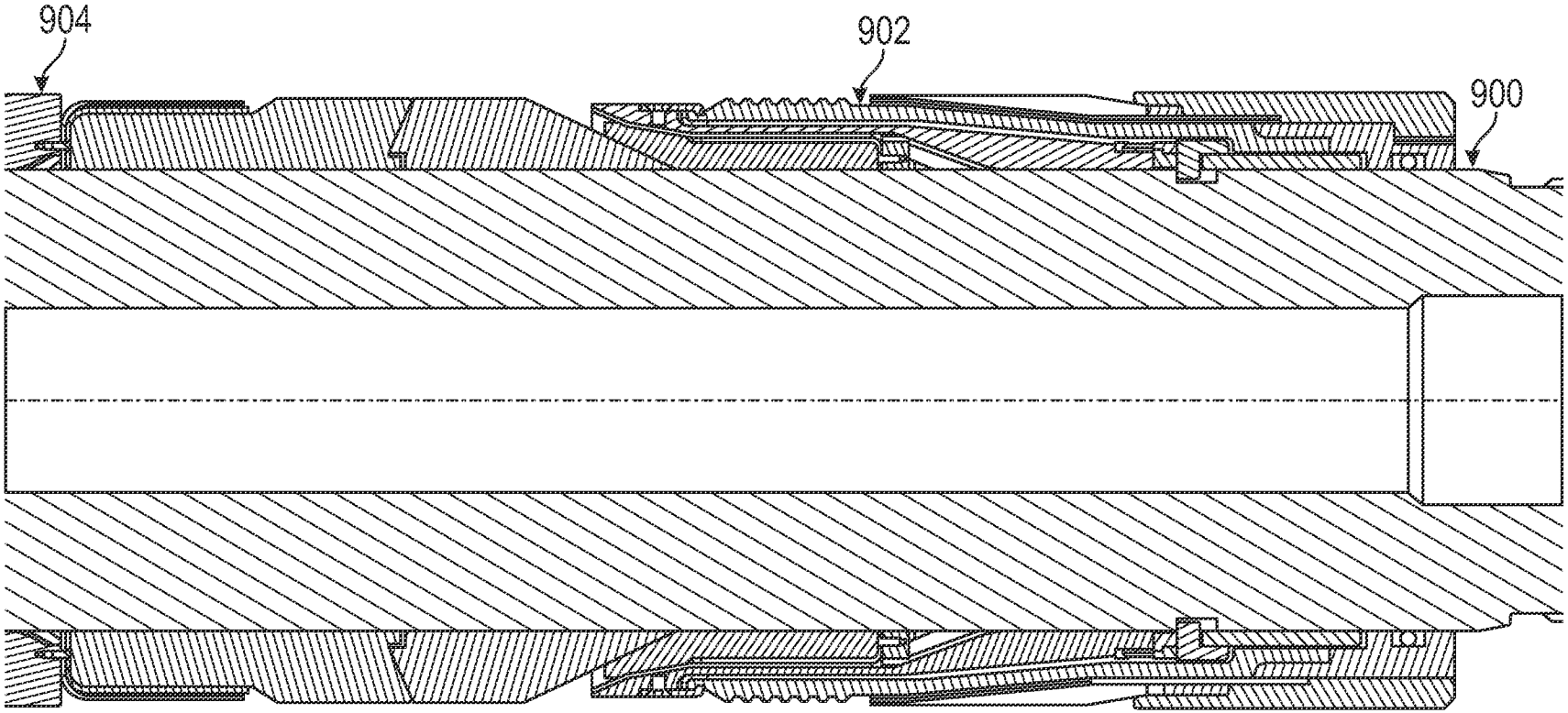
FIG. 9 is a seal assembly and a deployment system for a packer assembly according to one or more embodiments of the present disclosure.
Figure 10:
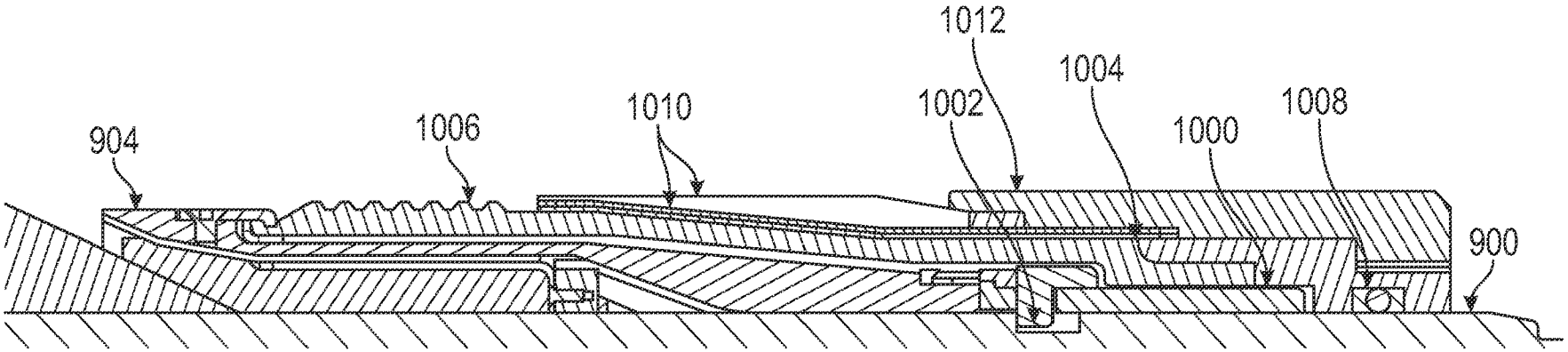
FIG. 10 is an enlarged view of the seal assembly of FIG. 9.
Figure 12:
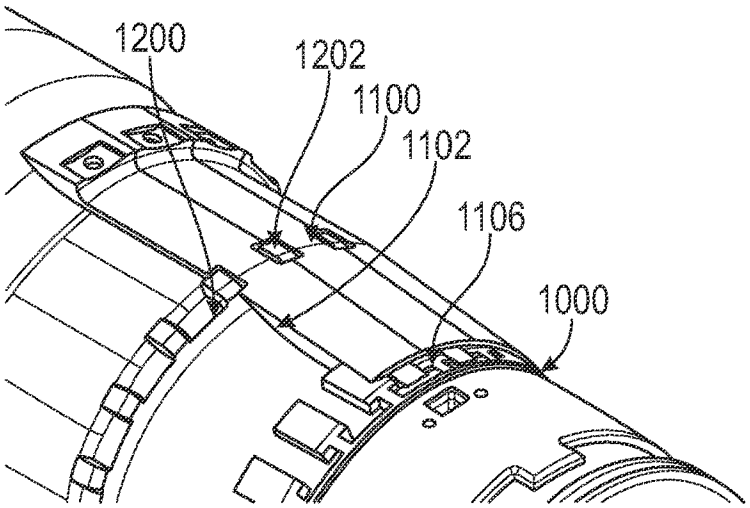
FIG. 12 is a partial, isometric view of the deployment system of FIG. 9.

Turning now to FIG. 9, FIG. 9 is a seal assembly 902 and a deployment system 904 usable in place of the seal assembly 202 and the deployment system 204 described above. As described above, when the deployment system radially expands the seal assembly 902 to seal the annulus between the mandrel 900 and a tubing or wellbore wall. As shown in FIG. 10, the seal assembly 902 includes a cup bonded element 1004, which includes a cup shaped sealing element 1006, coupled to a cup holder 1000. In one or more embodiments, a guide key 1002 prevents relative rotational movement between the cup holder 1000 and the mandrel 900. A seal 1008 is positioned between the cup bonded element 1004 and the mandrel 900 to restrict fluid flow through the inner diameter of the cup bonded element 1004. The cup bonded element 1004 may further include one or more foldback rings 1010 coupled to the cup holder 1000 via a ring holder 1012. As described above, the foldback rings 1010 prevent extrusion of the sealing element 1006.

Figure 11:
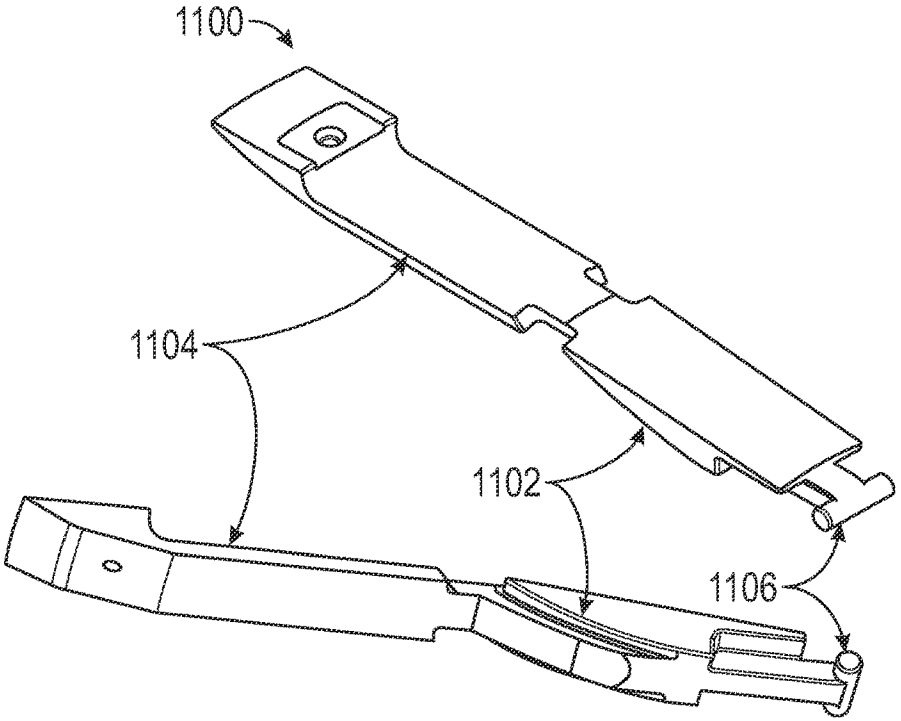
FIG. 11 is an arc arm of the deployment system of FIG. 9.

The deployment system 904 includes a plurality of arc arms 1100, as shown in FIG. 11. Each arc arm includes a ramp profile 1102, a bending tip 1104, and a pin profile 1106. The individual arc arms 1100 are coupled to the cup holder 1000 via a rotating joint, such as a pin in slot type mechanism, as shown in FIG. 11. The arc arms 1100 are positioned within slots in a pusher ring 1200 such that the ramp profile 1102 touches a pushing profile 1202 of the pusher ring.

Figure 13:
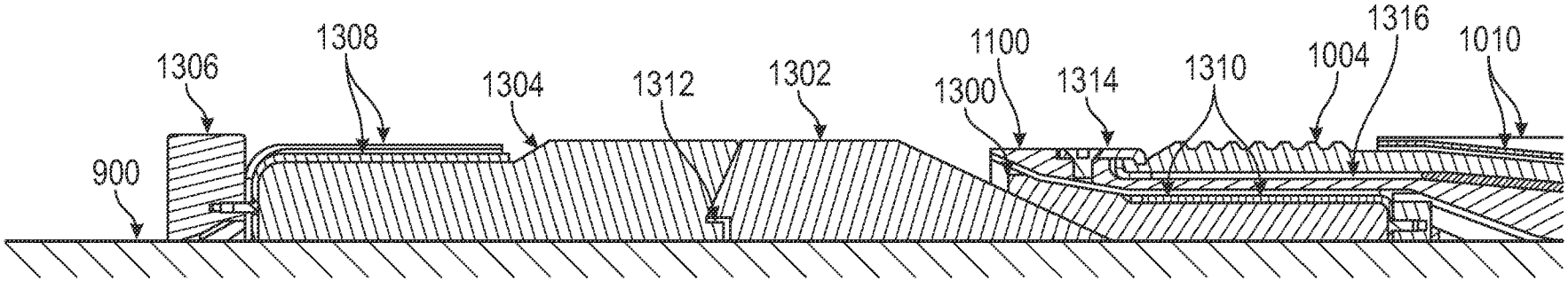
FIG. 13 is a cross-sectional view of the deployment system of FIG. 9.

In operation, the piston 1306 of the deployment system 904 actuates towards the arc arms 1100, as shown in FIG. 13. The movement of the piston 1306 causes the pusher ring 1200 to travel along the ramp profile of the arc arms 1100, which, in turn, causes the arc arms 1100 to rotate about the pin profile 1106 and expand the arc arms 1100 radially. The radial expansion of the arc arms 1100 deploys the sealing element 1006 to seal the annulus between the mandrel 900 and a tubular or wellbore wall. During the deployment, the bending tips 1104 of the arc arms 1100 bend to create a uniform contact stress with the wellbore wall to increase sealing strength. The bending of the arc arm 1100 also helps to deploy the sealing element 1006 in a non-circular, irregular well bore with equal contact stress distribution at every circumferential contact point with wellbore wall. In one or more embodiments, a liner 1316 is positioned between the sealing element 1006 and the arc arms 1100 to prevent extrusion of the sealing element 1006 as the sealing element 1006 is deployed.

In one or more embodiments, the deployment system 904 may also include a stack assembly to increase the contact stress of the seal assembly 902. The stack system include one or more cylindrical packing elements assembled in a stack. As shown in FIG. 13, the stack system may include three individual cylindrical packing elements 1300, 1302, 1304 made of an elastomeric material, which are enclosed between containment rings 1308, 1310 at either end. The containment rings 1308, 1310 prevent extrusion of the packing elements 1300, 1302, 1304 during deployment. In one or more embodiments, the containments rings 1308, 1310 are made of highly ductile material, composite, or polymers. The containment rings 1308, 1310 may also include slots to ease deployment. In such an embodiment, the containment rings 1308, 1310 may each include two rings arranged such that that slots in each of the rings are covered by the other ring to limit extrusion. The containment rings 1308, 1310 may be sized to delay the expansion of the packing elements 1300, 1302, 1304 so that higher load is being transferred to deploy the arc arms 1100 and the sealing element 1006.

The packing elements 1300, 1302, 1304 are arranged to help deploy the sealing element 1006 in a non-circular, irregular wellbore and increase contact stress between the sealing element 1006 and the tubular or wellbore wall. In one or more embodiments, the stack system includes an inner element 1300, a middle element 1302, and an end element 1304. The inner element 1300 and middle element 1302 may be made of a soft durometer elastomer (e.g., an elastomer having a durometer between approximately 60 and approximately 70) and the end element may be made of a hard durometer elastomer (e.g., an elastomer having a durometer of between approximately 80 and approximately 90). As shown in FIG. 13, the inner element 1300 and middle element 1302 have overlapping sloped portions and the middle element 1302 and the end element 1304 have overlapping sloped portions. The end element 1304 may also be radially locked with the middle element 1302 at a location 1312 below the sloped portions. In other, the packing elements 1300, 1302, 1304 may be wire-mesh, elastomer, or plastic bonded polymers that can deform, fold, and bend to compress in the oval or irregular wellbores and energize the sealing element 1006.

Once the piston 1306 deploys the sealing element 1006, the inner element 1300 radially expands over middle element 1302 as the stack system is compressed due to the overlapping sloped portions. Since the end element 1304 has a steep contact angle and locking engagement (L) with middle element 1302, end element 1304 also radially expands over middle element 1304 as the stack system is compressed and becomes positioned between the middle element 1302 and the inner element 1300. Once expanded, the inner element 1300 contacts the sealing element 1300 and increases contact stress between the sealing element 1006 and a tubular or wellbore wall in non-circular, irregular wellbores to improve sealing integrity. The packer elements 1300, 1302, 1304 may also generate contact stress with mandrel 900 to improve sealing integrity. The stack system also helps to expand individual arc arms 1100 to different radial distances from mandrel 900 to generate uniform contact pressure inside the irregular, non-circular wellbores.

In one or more embodiments, the seal assembly 902 also includes a plurality of individual anti-swab segments 1314, which lock the tip of the sealing element 1006 to the individual arc arms 1100. The anti-swab segments 1314 provide additional resistance against premature expansion of the sealing element 1006 while running the packer assembly downhole.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A packer assembly for use within a wellbore, the packer assembly comprising:

a mandrel;

a seal assembly disposed about the mandrel and comprising:

a cup holder; and a cup shaped sealing element coupled to the cup holder at a first end and deployable to create a seal between the mandrel and a wellbore wall; and a deployment system disposed about the mandrel and comprising:

a plurality of arc arms rotatingly coupled to the cup holder; and a stack assembly comprising a plurality of packer elements that, when compressed, rotate the plurality of arc arms to deploy the cup shaped sealing element, wherein the plurality of packer elements comprises an inner element, a middle element, and an end element;

wherein the inner element and the middle element are positioned such that a first portion of the inner element overlaps a first portion of the middle element;

wherein the middle element and the end element are positioned such that a first portion of the end element overlaps a second portion of the middle element; and wherein a first containment ring encloses a second portion of the inner element to prevent extrusion of the inner element and a second containment ring encloses a second portion of the end element to prevent extrusion of the end element.

2. The packer assembly of claim 1, wherein each of the plurality of arc arms is coupled to a second end of the cup shaped sealing element via respective anti-swab segments.

3. The packer assembly of claim 1, wherein the inner element and the middle element comprise an elastomer having a durometer between approximately 60 and approximately 70.

4. The packer assembly of claim 1, wherein the end element comprises an elastomer having a durometer between approximately 80 and approximately 90.

5. The packer assembly of claim 1, further comprising a liner positioned between the cup shaped sealing element and the plurality of arc arms to prevent extrusion of the cup shaped sealing element.

6. A completion system for use within a wellbore, the completion system comprising:

a tubing string positionable within the wellbore; and a packer assembly coupled to the tubing string and comprising:

a mandrel;

a seal assembly disposed about the mandrel and comprising:

a cup holder; and a cup shaped sealing element coupled to the cup holder at a first end and deployable to create a seal between the mandrel and a wellbore wall; and a deployment system disposed about the mandrel and comprising:

a plurality of arc arms rotatingly coupled to the cup holder; and a stack assembly comprising a plurality of packer elements that, when compressed, rotate the plurality of arc arms to deploy the cup shaped sealing element, wherein the plurality of packer elements comprises an inner element, a middle element, and an end element;

wherein the inner element and the middle element are positioned such that a first portion of the inner element overlaps a first portion of the middle element;

wherein the middle element and the end element are positioned such that a first portion of the end element overlaps a second portion of the middle element; and wherein a first containment ring encloses a second portion of the inner element to prevent extrusion of the inner element and a second containment ring encloses a second portion of the end element to prevent extrusion of the end element.

7. The completion system of claim 6, wherein each of the plurality of arc arms is coupled to a second end of the cup shaped sealing element via respective anti-swab segments.

8. The completion system of claim 6, wherein the inner element and the middle element comprise an elastomer having a durometer between approximately 60 and approximately 70.

9. The completion system of claim 6, wherein the end element comprises an elastomer having a durometer between approximately 80 and approximately 90.

10. The completion system of claim 6, wherein the packer assembly further comprises a liner positioned between the cup shaped sealing element and the plurality of arc arms to prevent extrusion of the cup shaped sealing element.

* * * * *